US010610758B2

(12) United States Patent
Abdul et al.

(10) Patent No.: US 10,610,758 B2
(45) Date of Patent: Apr. 7, 2020

(54) KICKING TEE FOR FOOTBALL AND RUGBY

(71) Applicants: David John Abdul, Hartville, OH (US); William Shafer, Massillon, OH (US)

(72) Inventors: David John Abdul, Hartville, OH (US); William Shafer, Massillon, OH (US)

( * ) Notice: Subject to any disclaimer, the term of this patent is extended or adjusted under 35 U.S.C. 154(b) by 0 days.

(21) Appl. No.: 16/140,892

(22) Filed: Sep. 25, 2018

(65) Prior Publication Data

US 2019/0091538 A1 Mar. 28, 2019

Related U.S. Application Data

(60) Provisional application No. 62/562,604, filed on Sep. 25, 2018.

(51) Int. Cl.
*A63B 69/00* (2006.01)
*A63B 1/00* (2006.01)

(52) U.S. Cl.
CPC ..... *A63B 69/0075* (2013.01); *A63B 1/00* (2013.01); *A63B 2243/007* (2013.01); *A63B 2243/0066* (2013.01)

(58) Field of Classification Search
CPC ..... A63B 69/0075; A63B 2243/0066; A63B 2243/007
See application file for complete search history.

(56) References Cited

U.S. PATENT DOCUMENTS 2,659,604 A * 11/1953 McGowen ..... A63B 69/0075 473/420
3,087,726 A * 4/1963 Albert ..... A63B 69/0075 473/420
3,309,087 A * 3/1967 Cullity ..... A63B 69/0075 473/420
3,481,602 A * 12/1969 Tatter ..... A63B 69/0075 473/420
3,516,667 A * 6/1970 Williams ..... A63B 69/0075 473/420
4,019,735 A * 4/1977 Thompson ..... A63B 69/00 248/362

(Continued)

FOREIGN PATENT DOCUMENTS

WO WO-2005068027 A1 * 7/2005 ..... A63B 69/0075
WO WO-2006024053 A1 * 3/2006 ..... A63B 69/0075

(Continued)

*Primary Examiner* — Steven B Wong
(74) *Attorney, Agent, or Firm* — Adam B. Portnow

(57) ABSTRACT

The invention discloses a kicking tee for American football or rugby that maximizes the possible forward lean of the football which extends the segment of impact through the ball while also exposing the entire ball from base to tip to the view of the kicker, allowing the kicker to more easily aim at the ball's sweet spot. The results achieved by use of the present invention are greater distance and height, velocity and hangtime, as well as greater control of the trajectory of the ball over that of the prior art. The invention also improves on the prior art by allowing a greater overall range of ball placement, resulting in the kicker having greater control over where the ball will travel on the field of play.

6 Claims, 14 Drawing Sheets

(56) References Cited

U.S. PATENT DOCUMENTS

| | | | | | |
|---|---|---|---|---|---|
| 4,418,910 | A * | 12/1983 | Stenerud | A63B 69/0075 | 473/420 |
| 4,537,397 | A * | 8/1985 | Kopp | A63B 69/0075 | 473/420 |
| 4,655,453 | A * | 4/1987 | Spiegel | A63B 69/0075 | 473/420 |
| 4,657,252 | A * | 4/1987 | Spiegel | A63B 69/0075 | 473/420 |
| 5,100,135 | A * | 3/1992 | Bourgeois | A63B 69/0075 | 473/420 |
| 6,309,316 | B1 * | 10/2001 | Spiegel | A63B 69/0075 | 473/420 |
| 2012/0058841 | A1 * | 3/2012 | Spiegel | A63B 69/0075 | 473/420 |
| 2012/0322586 | A1 * | 12/2012 | Mourouzis | A63B 69/002 | 473/419 |
| 2012/0329582 | A1 * | 12/2012 | Spiegel | A63B 69/0075 | 473/420 |
| 2014/0349784 | A1 * | 11/2014 | Holland | A63B 69/0075 | 473/420 |
| 2015/0182832 | A1 * | 7/2015 | Spiegel | A63B 69/0075 | 473/420 |
| 2018/0071606 | A1 * | 3/2018 | Masterson | A63B 69/0075 | |

FOREIGN PATENT DOCUMENTS

| | | | | |
|---|---|---|---|---|
| WO | WO-2012019221 | A1 * | 2/2012 | A63B 69/0075 |
| WO | WO-2014032112 | A1 * | 3/2014 | A63B 69/0075 |

* cited by examiner

KICKING TEE FOR FOOTBALL AND RUGBY

FIELD OF INVENTION

The present invention relates to the field of sporting equipment and accessories, specifically to a kicking tee for any prolate spheroid-shaped ball, such as those used in American football and rugby.

BACKGROUND OF THE INVENTION

Kicking tees that exist in modern sport and are widely known, particularly with respect to football and rugby, are generally plastic or rubber platforms having prongs extending upwards or a brim around an inner depression. The prior art in this field is plentiful with many variations of regulation kicking tees, all of which present drawbacks that are solved by the present invention, which discloses a new and unique kicking tee with multiple improvements over the prior art.

With current widely used kicking tees, there is some guesswork as to the "sweet spot" of the football and setting it up for the ideal kicking angle, depending on the type of kick and desired trajectory of the ball. The structure of the prior art tees provides a limited degree range of ball lean and placement angles that the tee can support so that contact can be made with the football's sweet spot; and often result in the ball falling over in high wind conditions.

Additionally, many prior art tees, as a result of the hardness of materials of the tees or the height of the prongs have caused injuries by players kicking the tee, falling on top of the tee or by running or rolling over the tee during the play.

Several attempts have been made to perfect kicking tees in this field of invention including those found in the following prior art: U.S. Pat. No. 3,309,087, issued Mar. 14, 1967 to Cullity; U.S. Pat. No. 3,516,667, issued Jun. 23, 1970 to Williams; U.S. Pat. No. 4,428,910 issued Dec. 6, 1983 to Stenerud; U.S. Pat. No. 4,537,397 issued to Kopp; U.S. Pat. No. 4,657,252 issued Apr. 14, 1987 to Speigel; U.S. Pat. No. 5,690,564 issued Nov. 25, 1996 issued to Frantz; U.S. Pat. No. 5,690,564 issued Nov. 25, 1997 issued to Hassard; U.S. Pat. No. 6,309,316 issued Oct. 30, 2001 to Spiegel; U.S. Patent Pub. No 2004/0097304 published on May 20, 2004, by Sharp; U.S. Patent Pub. No. 2012/0058841 published Mar. 8, 2012 by Spiegel; U.S. Pat. No. 8,262,514 issued Sep. 11, 2012 to Spiegel; U.S. Patent Pub. No. 2012/0329582 published Dec. 27, 2012 to Spiegel; U.S. Pat. No. 8,469,840 issued Jun. 25, 2013 to Mourouzis; U.S. Patent Pub. No. 2014/0349784 published Nov. 27, 2014 by Holland; U.S. Patent Pub. No. 2015/0182832 published Jul. 2, 2015 by Spiegel; and International References including: WO 2005/068027 issued Jul. 28, 2005 to Davis; WO 2006/024053 issued Mar. 2, 2006 to Annandale; WO 2012/019221 issued Feb. 16, 2012 to Hopgood.

The present invention addresses a long felt need in the art by presenting a kicking tee capable of a greater degree of placement angles, improved performance, versatility and safety, making the present invention unique, useful, and highly marketable over all prior art in the field.

SUMMARY OF THE INVENTION

The invention discloses a kicking tee for American football or rugby that maximizes the possible forward lean of the football which extends the segment of impact through the ball while also exposing the entire ball from base to tip to the view of the kicker, allowing the kicker to more easily aim at the ball's sweet spot. The results achieved by use of the present invention are greater distance and height, velocity and hangtime, as well as greater control of the trajectory of the ball over that of the prior art. The invention also improves on the prior art by allowing a greater overall range of ball placement, resulting in the kicker having greater control over where the ball will travel on the field of play.

The base height may be made according to current NFL and NCAA regulations making the base height of the tee one (1) inch, or two (2) inches for use with youth and U.S. national high school (NFHS) regulations. For the two (2) inch embodiment of the tee, the base of the tee is also extended lengthwise to accommodate the additional height (not shown in the drawings).

A first object of the invention is to provide a kicking tee with maximum forward lean to create optimal hangtime (height) and distance of the ball travelling through the air by maximizing the segment of the ball that is contacted by the foot, allowing for a greater transfer of power from the kicker's foot to the ball upon impact from the sweet spot of the ball through the exit point.

A second object of the invention is to provide a kicking tee that allows a kicker to see the entire surface area from the bottom to the top tip of the ball for improved control and unobstructed contact when kicked.

A third object of the invention is to provide a kicking tee that allows for a greater overall range of ball placement on the tee than what currently exists in the prior art.

A fourth object of the invention is to provide a kicking tee that is safer on the field by not having any elongated prongs, sharp edges, and being manufactured to a durometer of hardness that will not cause serious injury should it be fallen upon.

The present invention fulfills the above and other objects by providing a tee having unique and useful features as described herein.

The above and other objects, features and advantages of the present invention should become more readily apparent to those skilled in the art upon a reading of the following detailed description in conjunction with the drawings, wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
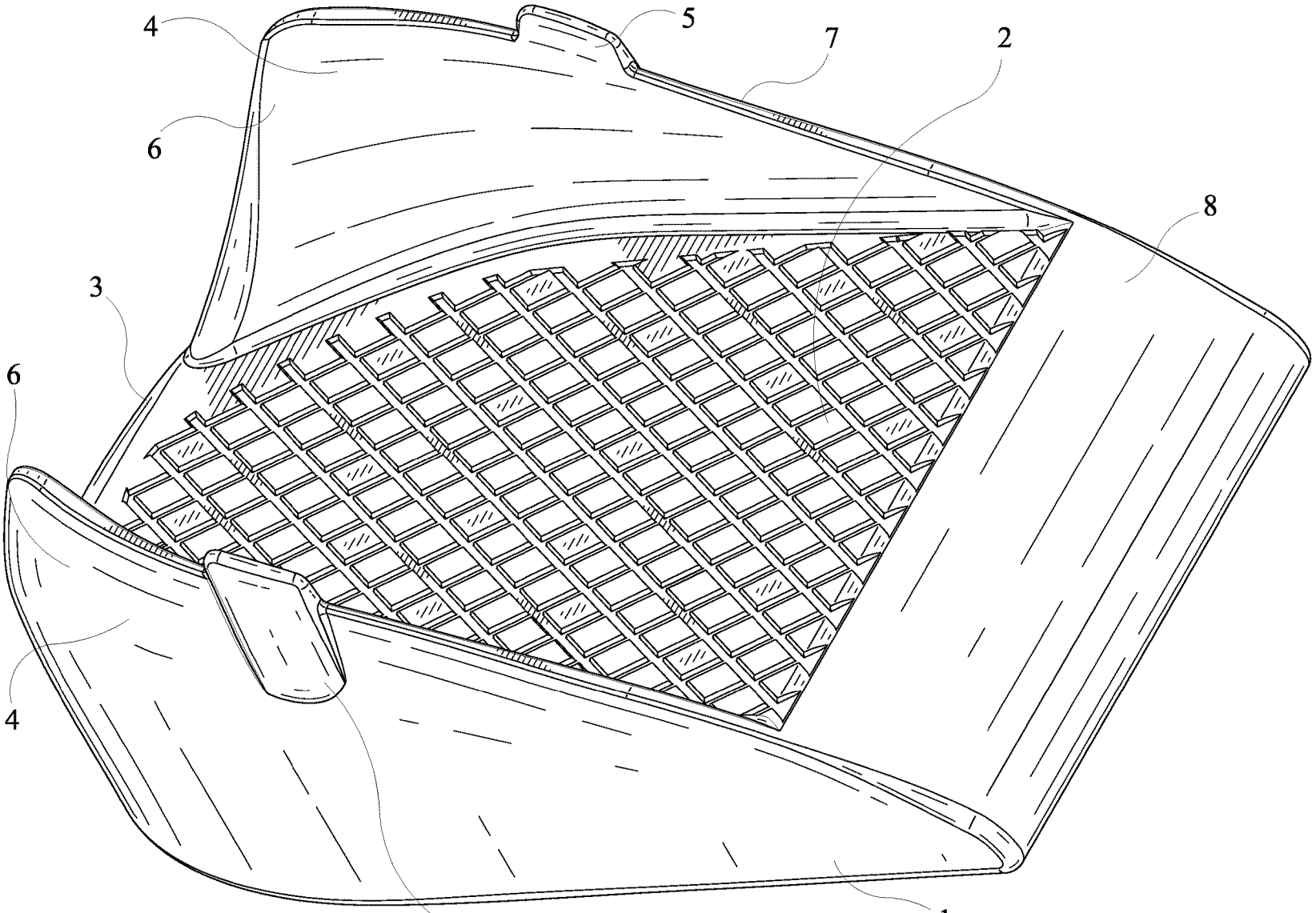
FIG. 1 is an isometric view of the preferred embodiment of the invention having a one (1) inch base from the ground.
Figure 2:
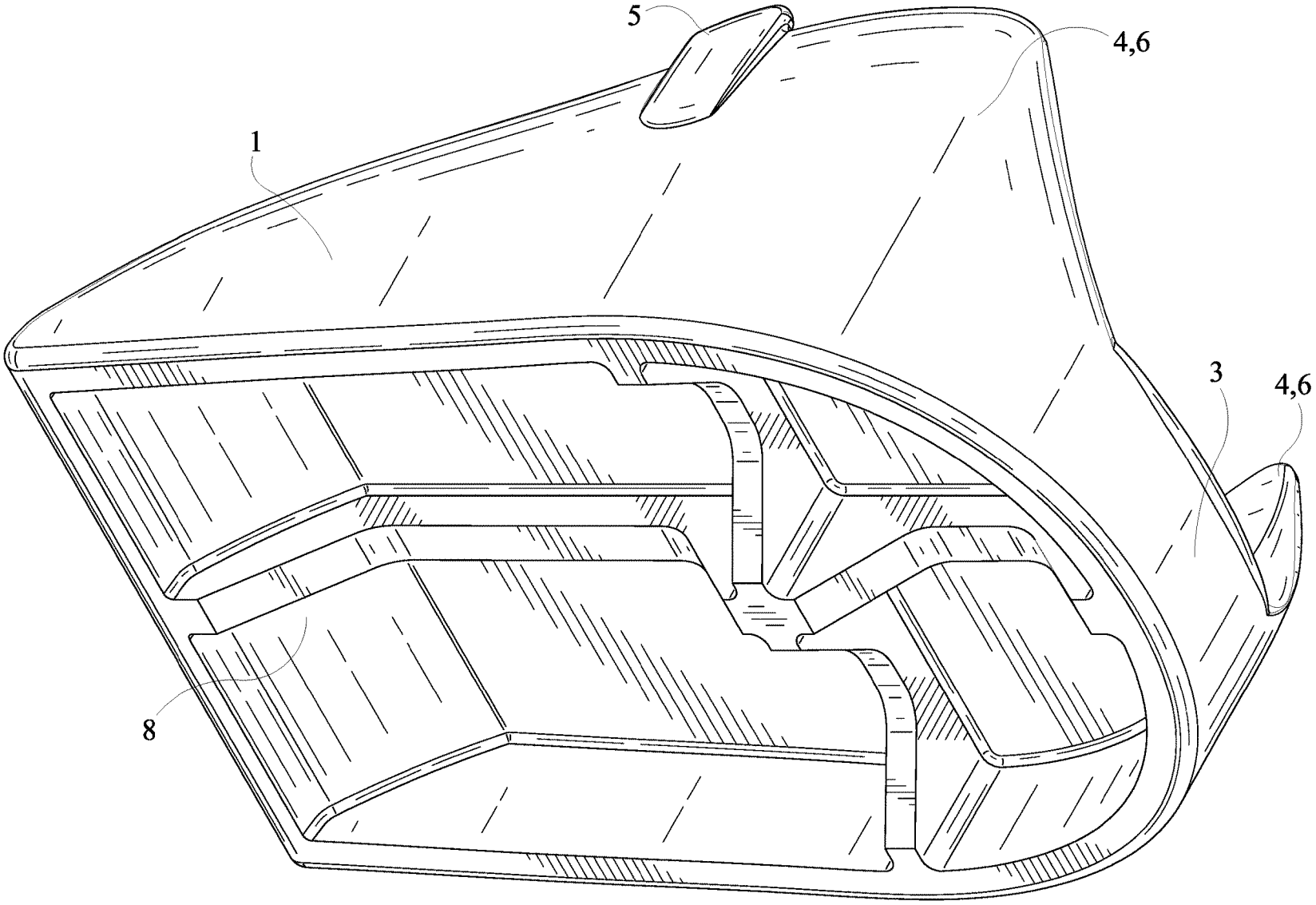
FIG. 2 is an isometric view from underneath the base component of an embodiment of the invention.
Figure 3:
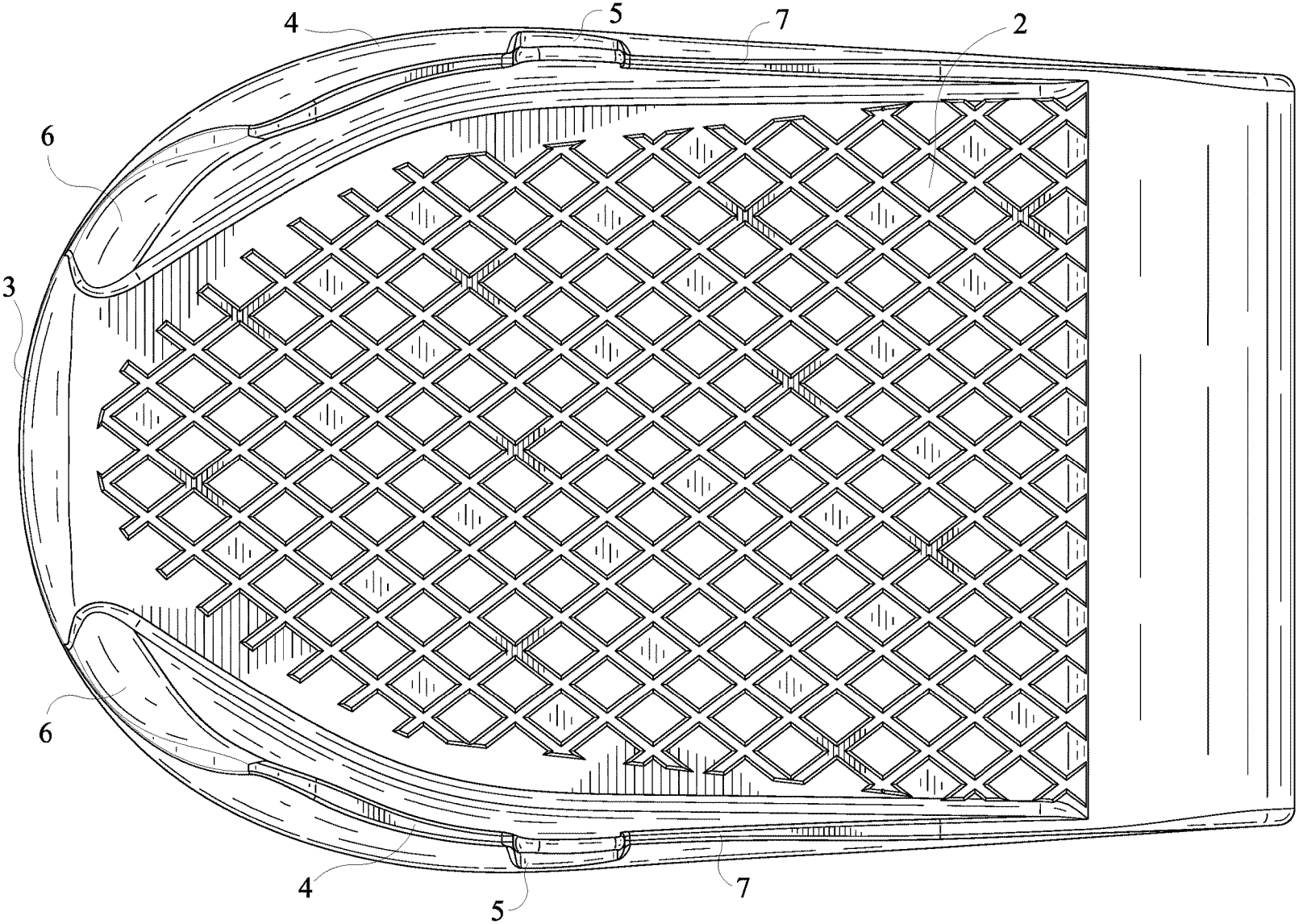
FIG. 3 is a top-down view of the preferred embodiment of the invention.
Figure 4:
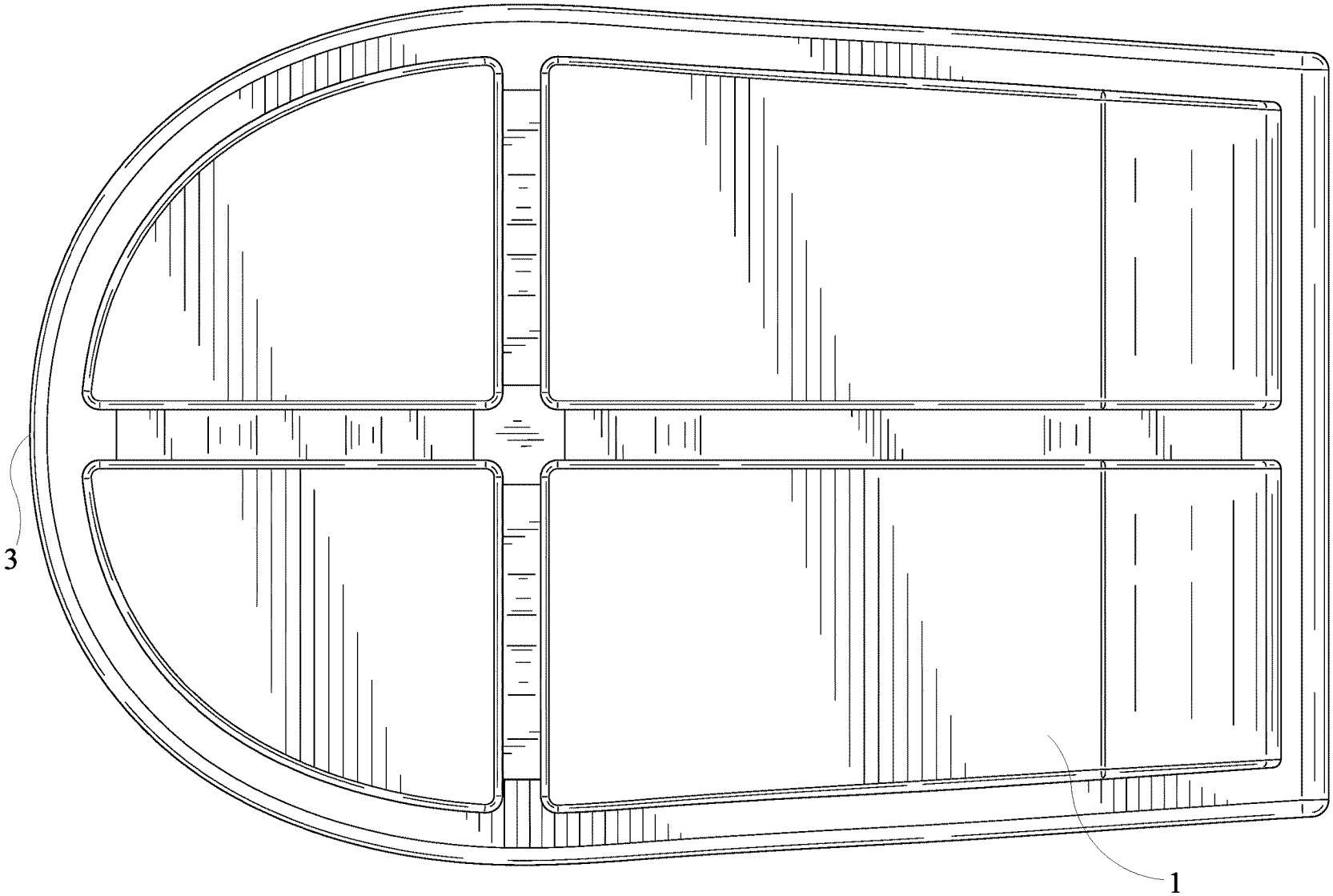
FIG. 4 is a bottom-up view of an embodiment of the base of the invention.
Figure 5:
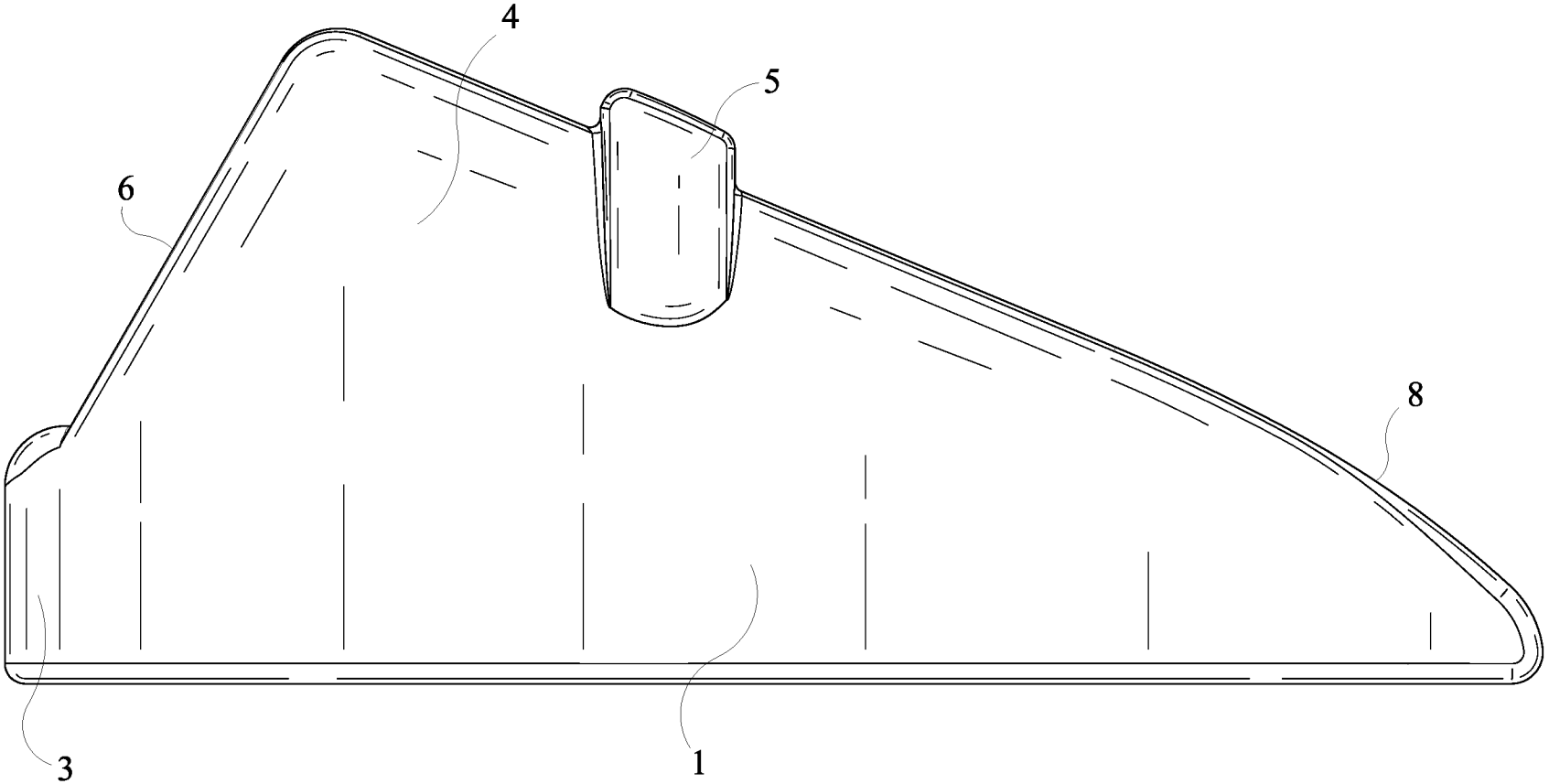
FIG. 5 is a side view of the preferred embodiment of the invention.
Figure 6:
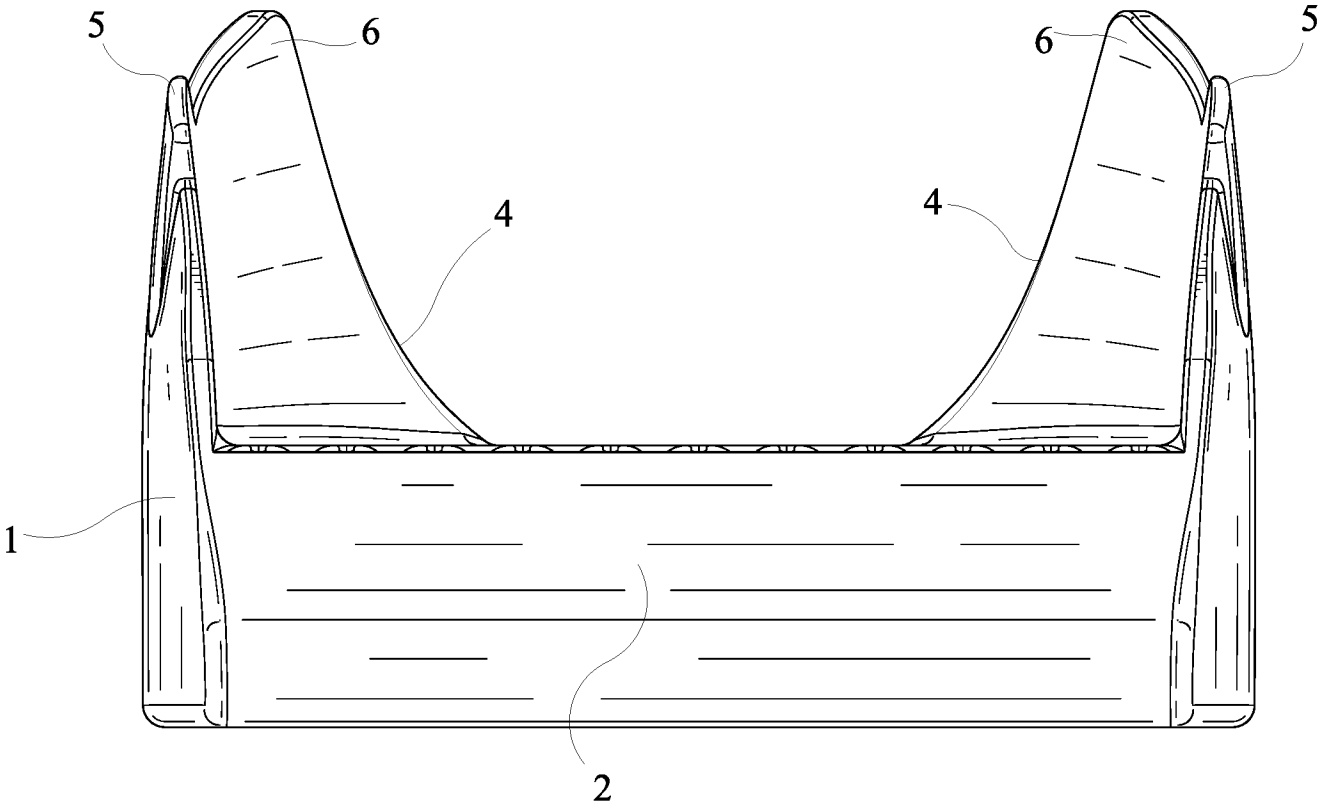
FIG. 6 is a front view of the preferred embodiment of the invention facing the slope of the tee's platform.
Figure 7:
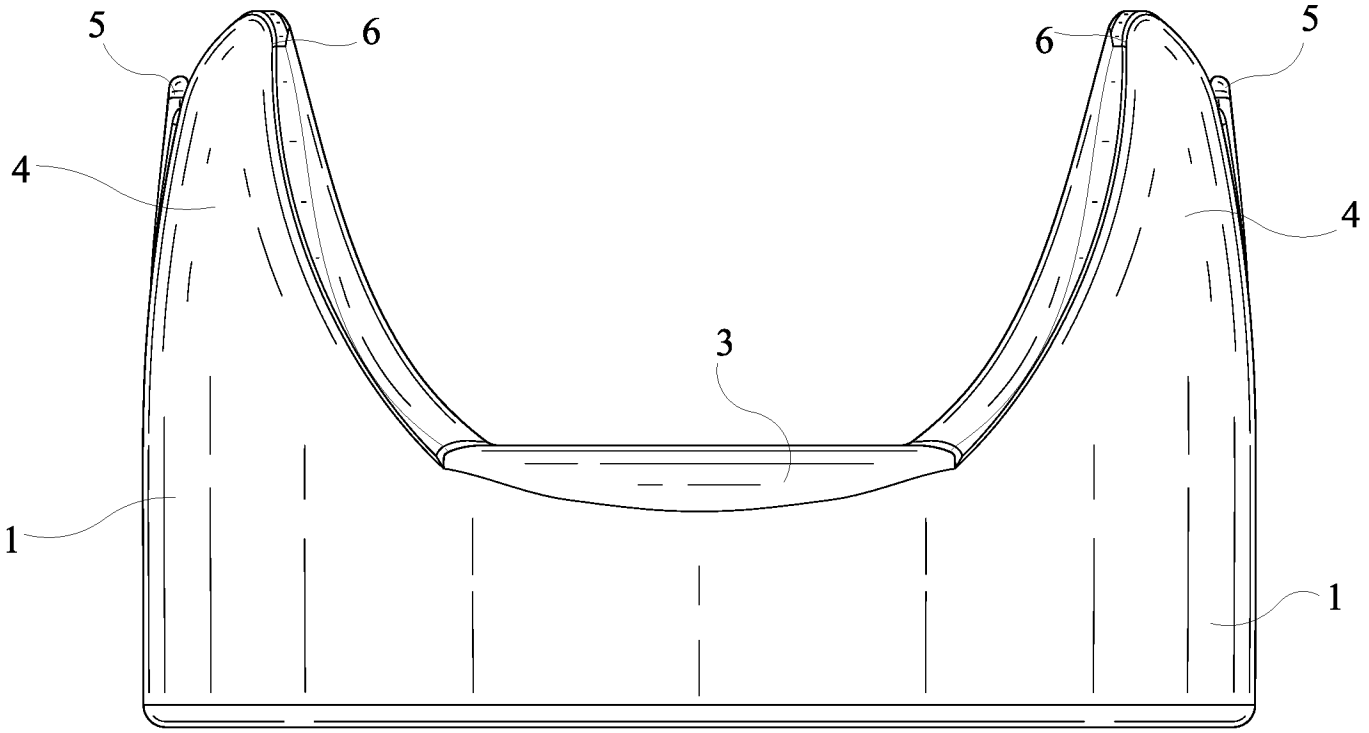
FIG. 7 is a rear view of the preferred embodiment of the invention facing the heel of the tee.

For purposes of describing the preferred embodiment of the present invention, the terminology used in reference to the numbered components in the drawings is as follows:

1. Base
2. Platform
3. Heel
4. Sidewalls
5. Tabs
6. Sidewall curvature
7. Sidewall upper edge
8. Kicking Tee ("tee")
A. Segment vector of impact (prior art)
B. Greater segment vector of impact (present invention)
C. Exit vector
X. Sweet spot of the ball (optimal point of contact)

The preferred embodiment of the invention as shown in FIGS. 1-7 has a base (1) that is supportable on a ground surface, a sloping platform (2) that may have a knurled crosshatch (as shown in the drawings as one example) or any other textured pattern on its surface to provide a friction grip maintaining the placement angle and resisting slippage of the football on the tee (8). The platform (2) can be manufactured to a height or length to accommodate any league's regulations for kicking tees. The invention can accommodate any size ball from junior youth sized footballs to balls for professional football and rugby. The embodiment shown in the drawings has sloping platform (2) and sidewall (4, 6) features that allow a kicker to see the entire football from the bottom of the ball to the tip without the nose of the ball being held by a recessed in a depression, as shown in FIGS. 8-14. This is a significant and marketable difference over prior art tees. The unique sloping wedge-shaped platform (2) also allows for unobstructed upward movement of the kicking foot and complete contact with the ball. With such unobstructed contact, the kicker is more easily able to apply the maximum amount of force to the sweet spot of the ball (X), which directly correlates to greater velocity of the ball travelling through the air.

Figure 8:
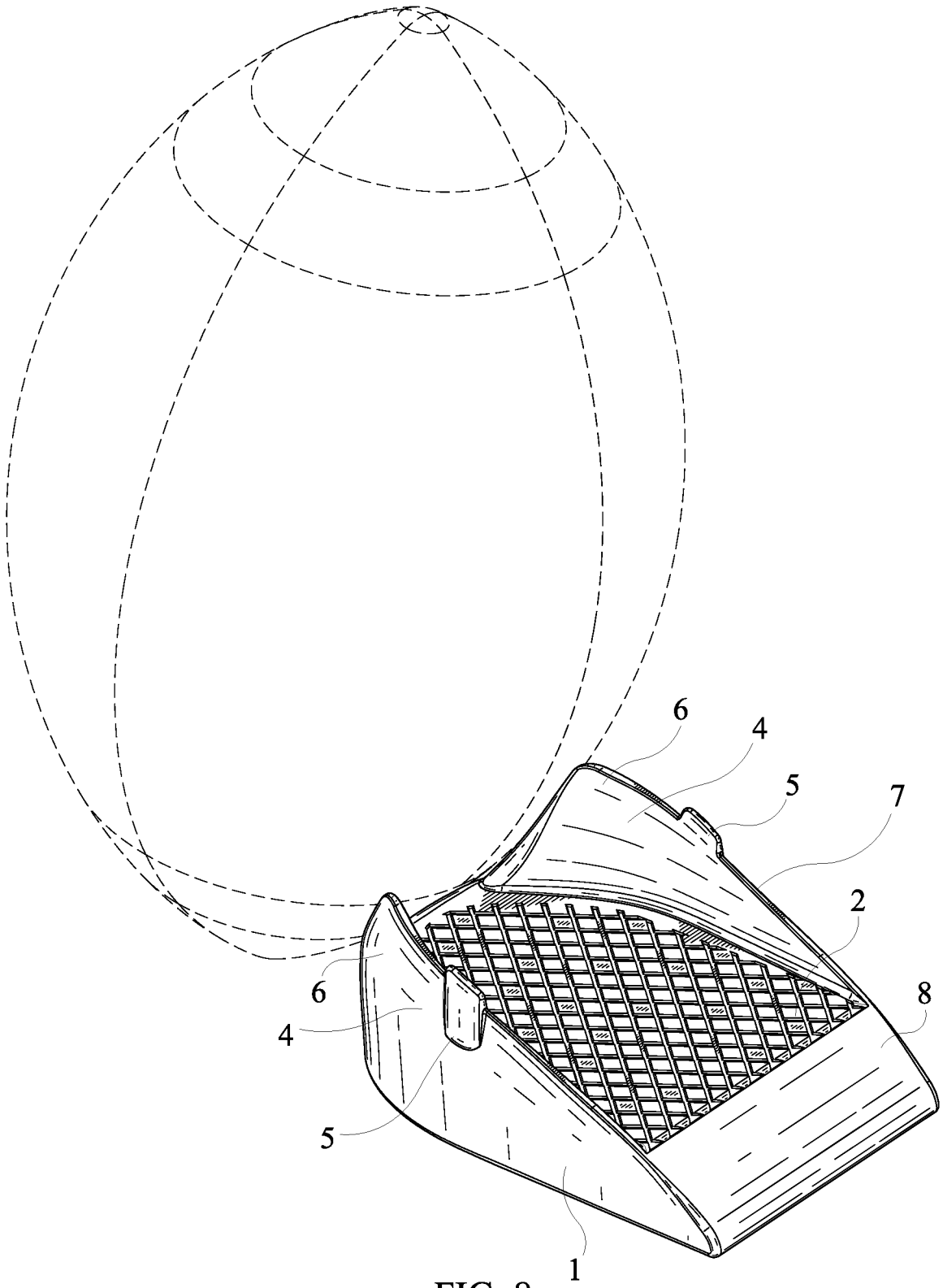
FIG. 8 shows a ball placement for an optimal onside kick as contemplated by the preferred embodiment of the invention.
Figure 9:
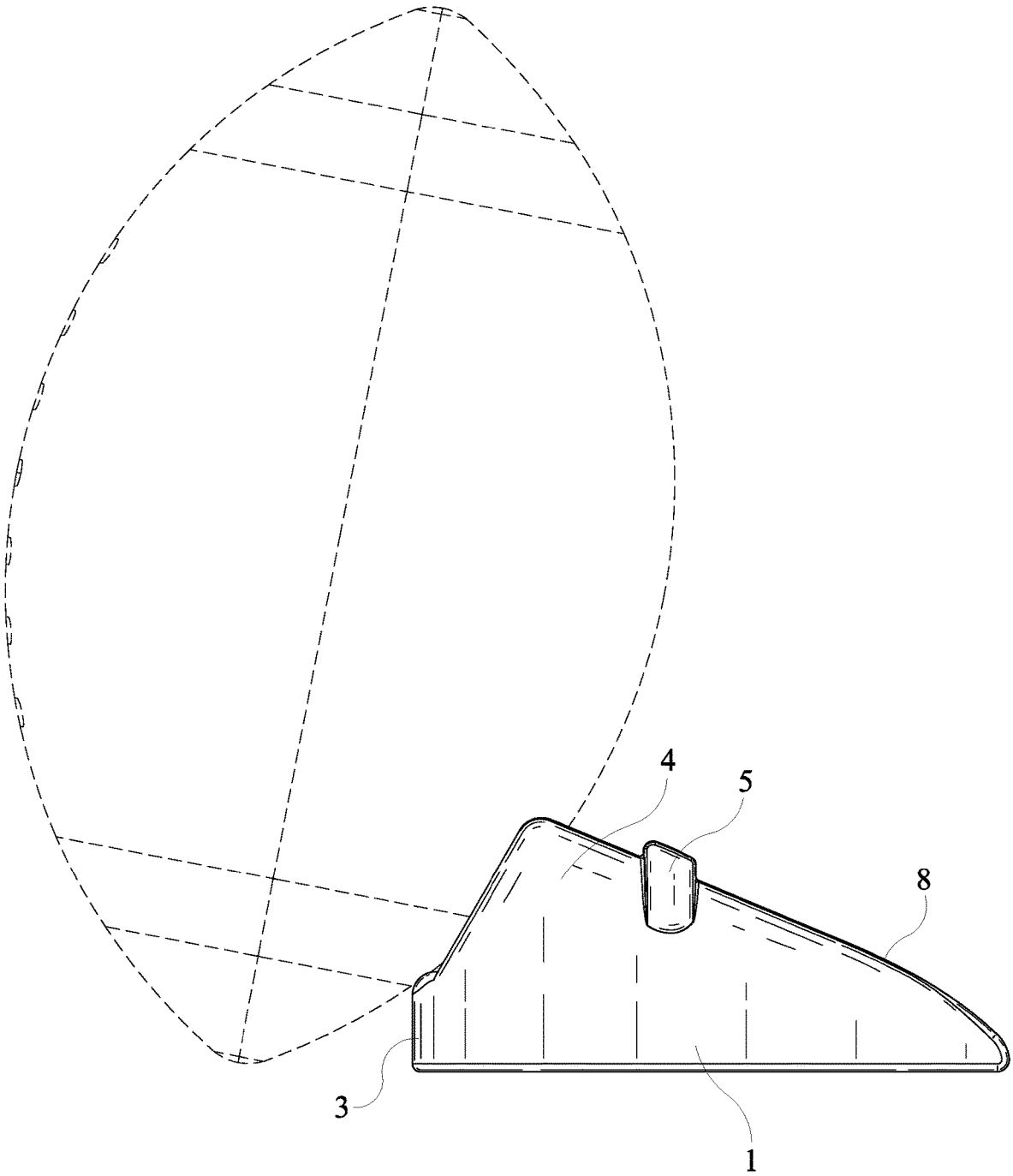
FIG. 9 shows a side view of the ball placement for an optimal onside kick as contemplated by the preferred embodiment of the invention as in FIG. 8.
Figure 10:
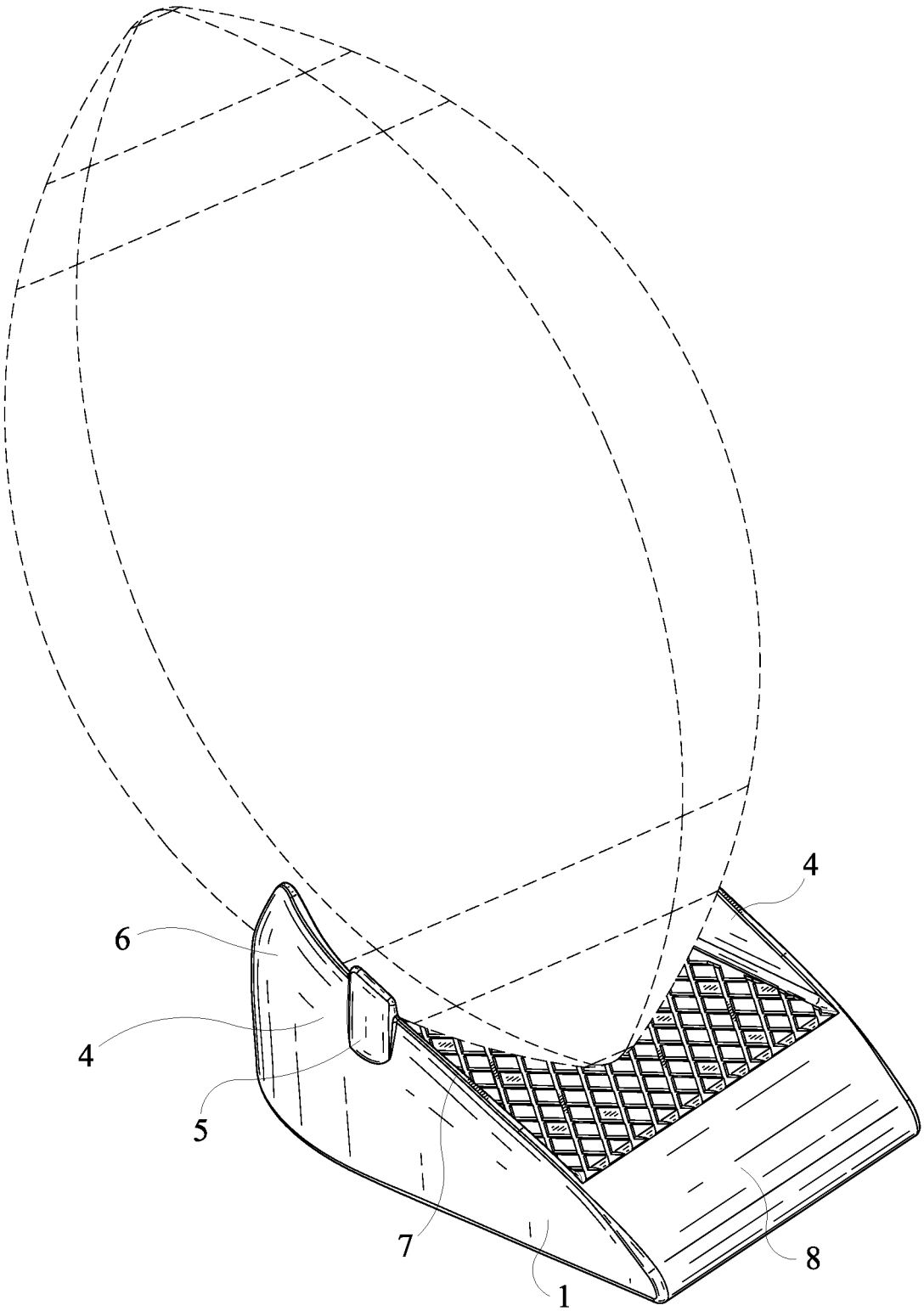
FIG. 10 shows a ball placement for the optimal forward lean uniquely achieved by the preferred embodiment of the invention.
Figure 11:
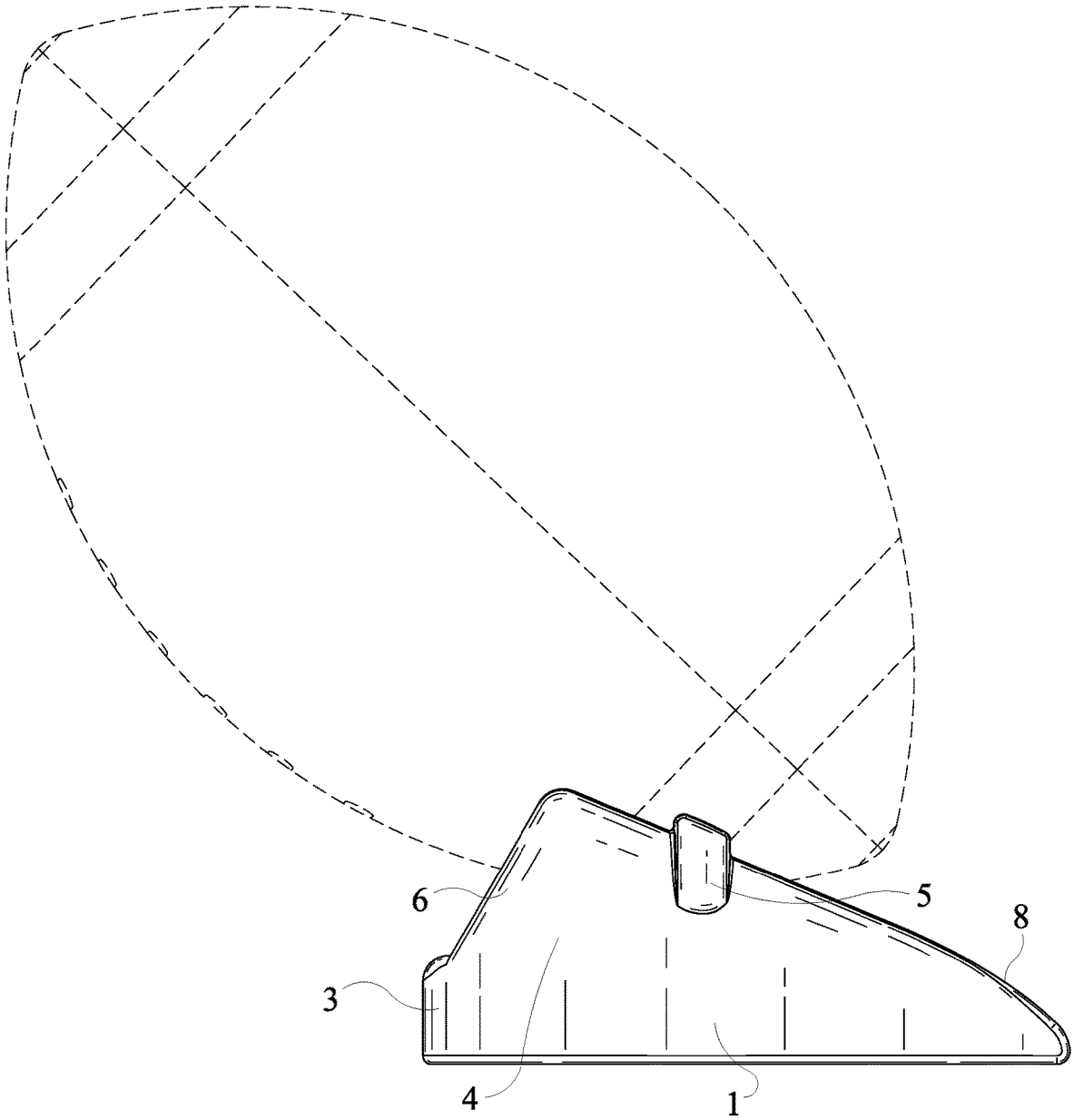
FIG. 11 shows a side view of the ball placement for the optimal forward lean of the preferred embodiment of the invention as in FIG. 10.
Figure 12:
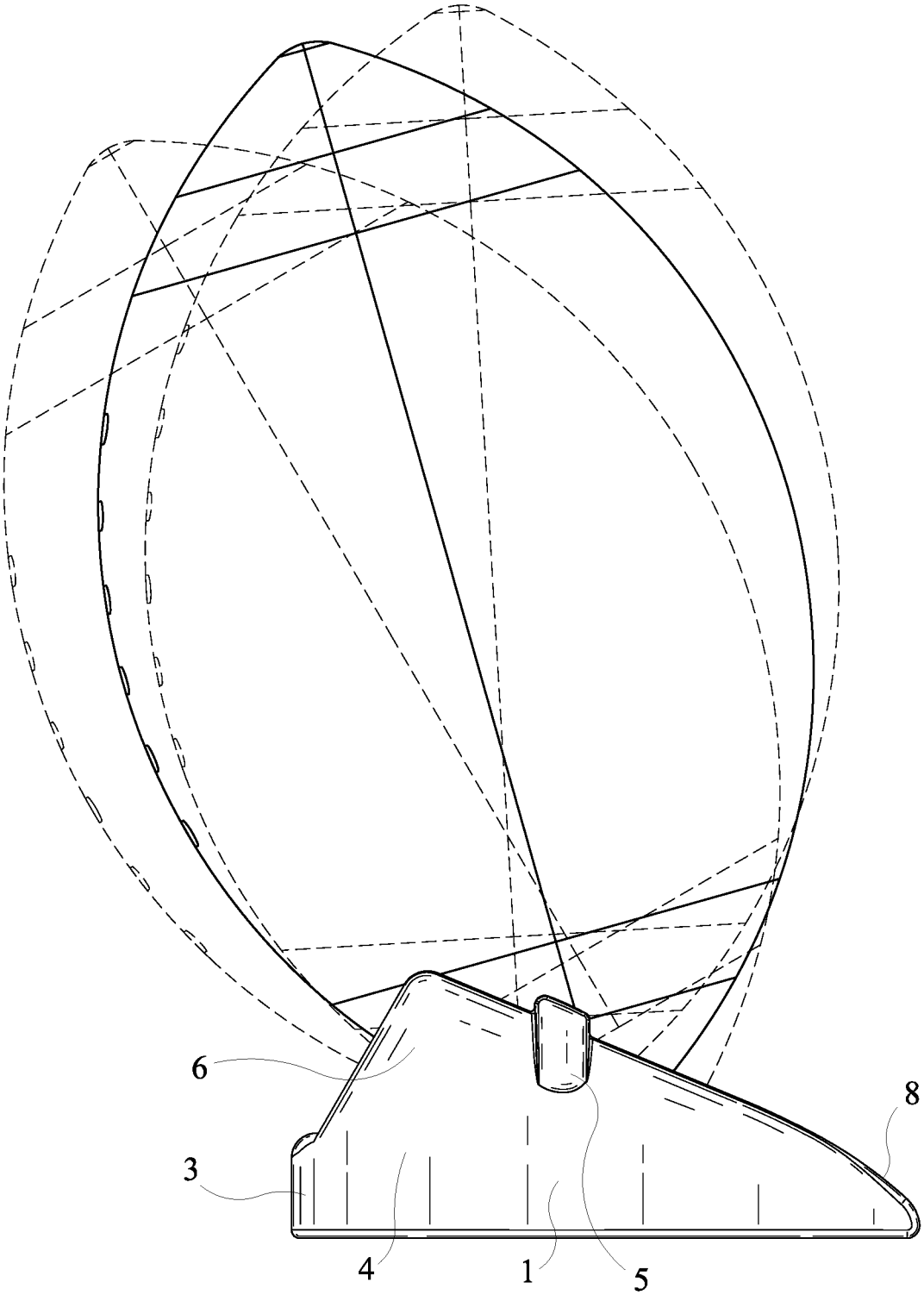
FIG. 12 shows a variety of range of placement of a ball having a forward lean on the preferred embodiment of the invention.
Figure 13:
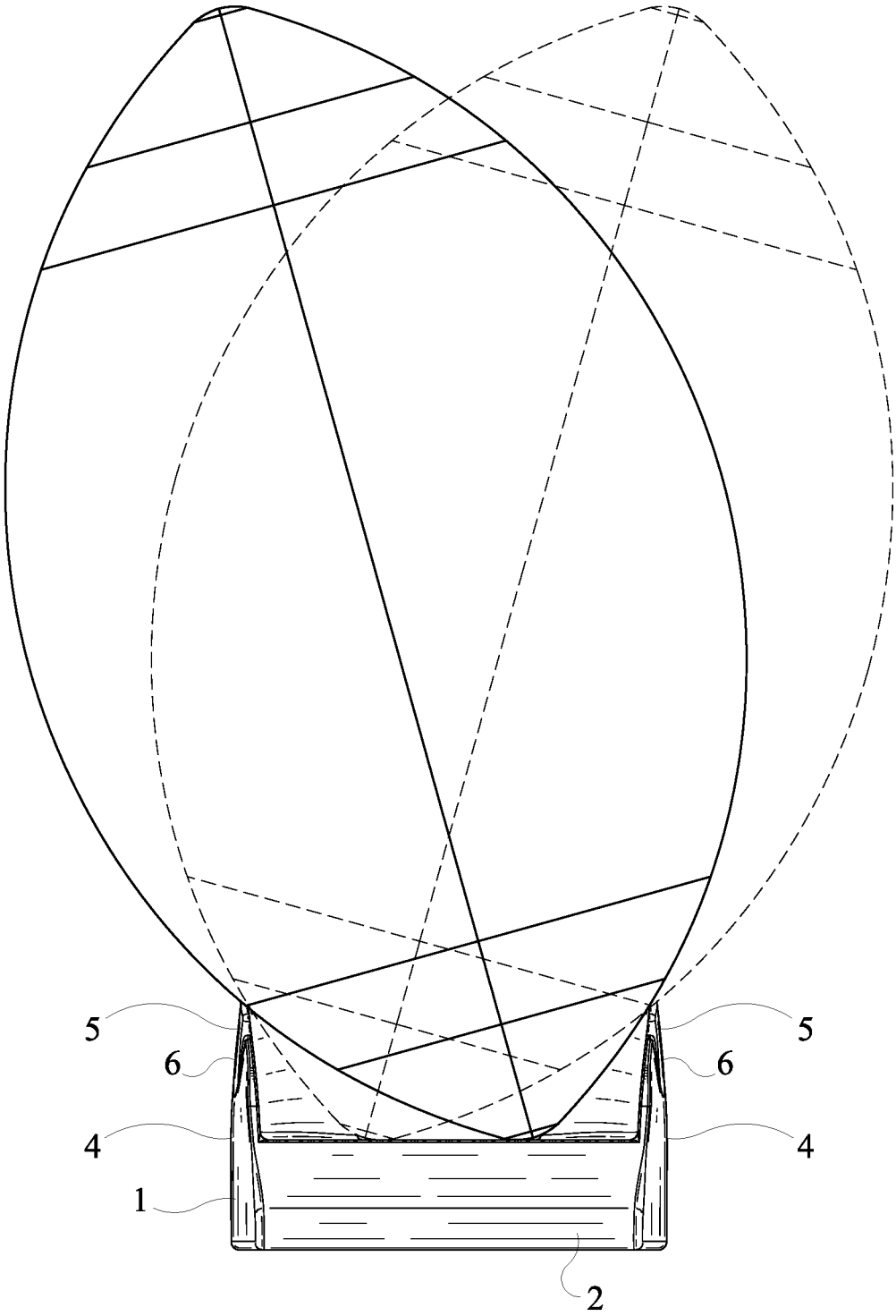
FIG. 13 shows a variety of left and right leaning ball placement options of the preferred embodiment of the invention.

The preferred embodiment of the invention has sidewalls (4) having a curvature (6) around the heel (3), sloping upward from the outer edges of the heel (3) with a gap to accommodate a ball for onside kicks shown in FIGS. 8 and 9. The sidewalls (4) have tabs (5) that protrude generally perpendicular to the platform (2) along the upper edge (7) of the sidewalls (4). As shown in the figures, the sidewalls (4) and tabs (5) curve with the heel (3) to conform to the general shape of a prolate spheroid-shaped ball and provides significantly greater support for the ball at a wider range of placement angles compared to the prior art. An exemplar of the range of placement angles are shown in FIGS. 8-14: FIGS. 8 and 9 show a placement of a ball for an optimal onside kick; FIGS. 10 and 11 show the optimal forward lean position of the ball with several variations of degree of ball placement shown in FIG. 12; and the range of left and right-leaning ball placement is shown in FIG. 13 showing the invention's versatility and use by right and left-footed kickers.

The unique shape of the sidewalls (4) and tabs (5) and the sloped platform (2) allow for the ball to sit securely while not interfering with the travel of the ball. The sloping platform (2) and angle of placement allowed by the sidewalls (4) and tab (5) features of the invention—and the elimination of a recessed depression, prongs, teeth, or other elements of prior art tees that obstruct the foot's impact on the ball—allow a kicker to more easily find and have greater control over the ball's sweet spot (X) and exit vector (C), and have greater manipulation over the height, hangtime, distance, and maximum control of the trajectory of the ball. The unique placement angles of the invention and greater segmental impact result in achieving greater heights and distances of kickoffs and more successful pooch kicks or onside kicks compared to the prior art tees.

Figure 14B:
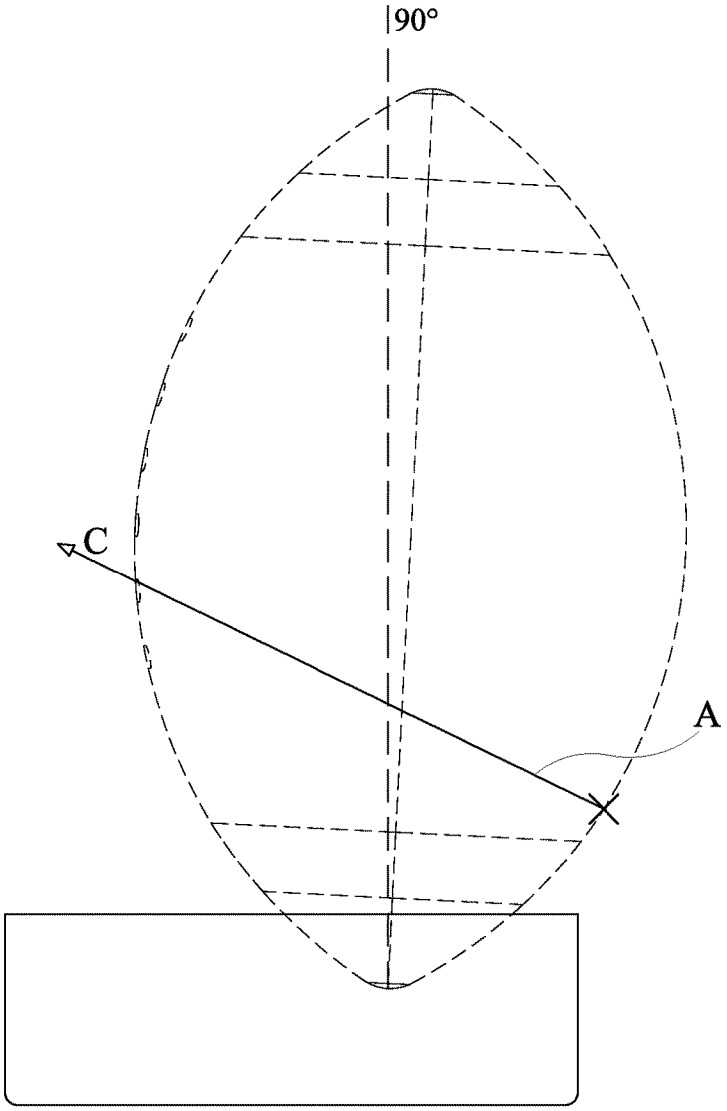
FIGS. 14A and 14B is a side by side comparison of the present invention (14A) to a prior art tee (14B) showing a greater segment of the ball that is impacted by a kicker achieved by use of the present invention compared to that of the prior art.
Figure 14A:
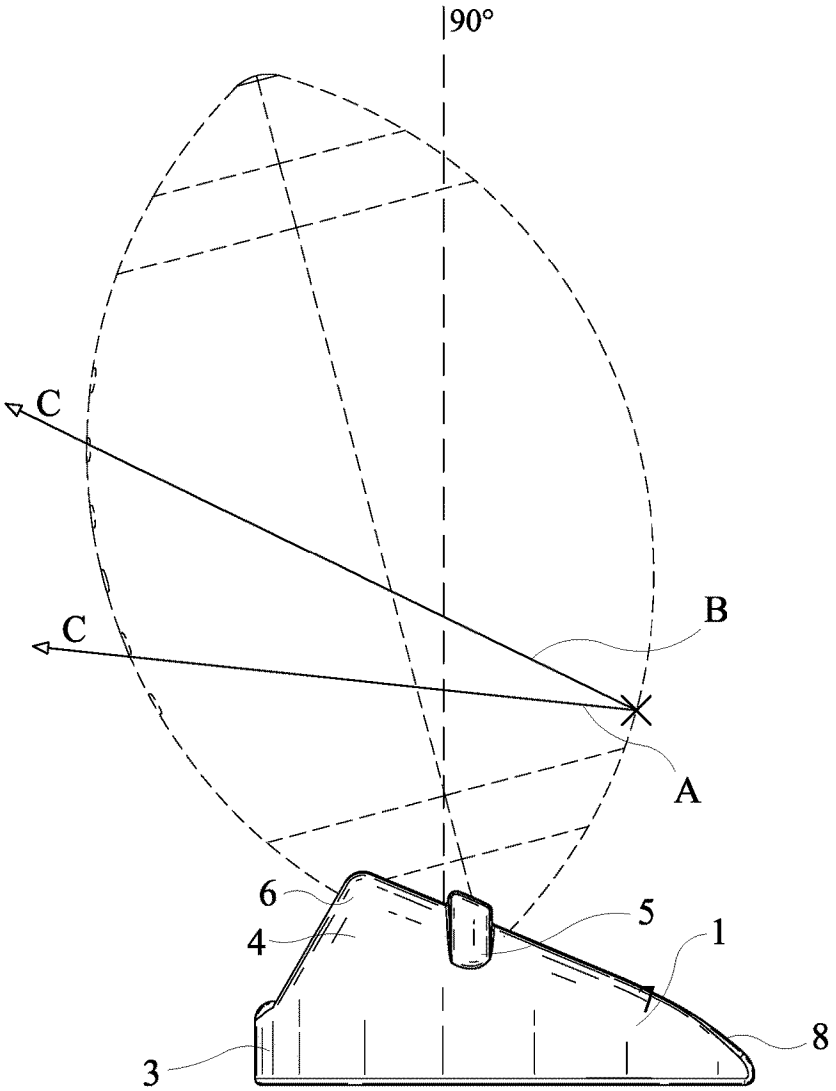

FIGS. 14A and 14B shows a side by side comparison of the ball placement angle of present invention to that of a traditional prior art tee. In the prior art tee of FIG. 14B the ball placement would be slightly "backward" or less than 90 degrees. As shown in FIG. 14A in comparison, the ball is capable of being placed with a forward lean significantly greater than 90 degrees, and greater than any prior art tee allowing for similar forward lean placement. The segment A shown in FIGS. 14A and 14 B is the length of the football that is impacted by the kicker when contact is made with the ball's sweet spot (X). Segment B in FIG. 14A represents the greater segment length that is capable of being impacted by use of the kicking tee embodied in the present invention.

A trend among top performing field goal kickers is to apply a forward lean to the ball when placed on a kicking tee as in FIGS. 10, 11, and 14A. This allows the kicker to more easily gain height and distance. Generally, with a forward lean applied, the angle of impact of the kicker's foot transfers more energy to the ball, producing greater travel distance and height; especially with the prevailing soccer style of kicking. The greater segment length is a significant improvement over prior art tees and allows a kicker to achieve greater hangtime and distance. The degree of forward lean and longer segment of impact achieved by the present invention FIG. 14 compared to the prior art is a unique and significantly useful feature of the invention that has great potential to influence strategy and overall play in various American football and rugby leagues.

Additionally, the unique sidewall (4) and tab (5) design of the invention provides increased wind tolerance over the prior art. The unique features of the invention securely brace the ball and hold it in place at greater wind velocities than most other tees currently available on the market, and especially those typically used in current league play at all levels. The invention accomplishes this while not hindering the ball from travelling smoothly off the tee when kicked.

The invention can be manufactured using injection molding process and be made of plastic polymer or rubber material at a relatively inexpensive price point. The present invention is also safer to use than those in the prior art that rely on pointed vertical prongs for football support. The invention can be made to any durometer of hardness. The preferred embodiment of the invention would be composed of a rubber durometer hardness capable of indentation or bending if a player falls upon it, creating a greater degree of safety and avoiding any serious bodily harm to the players. The preferred embodiment of the invention as seen in FIGS. 1-8 incorporates rounded elements and lacks any sharp or piercing prongs or edges.

The invention can also be made at any height to meet specific requirements of league play (for example, National Federation of State High School Associations regulations allow for a tee up to two (2) inches in height; whereas the National Football League and the National Collegiate Athletic Association regulations currently require use of a one (1) inch tee. In addition, the invention can accommodate the junior size football used for younger players participating in leagues such as Pop Warner and American Youth Football and Cheer, along with their permissible two (2) inch base height. In the two-inch embodiment of the tee, not shown in the drawings, the length of the base (1) and sloping platform (2) and sidewalls (4) are extended to compensate for the additional height.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A kicking tee comprising:

(a) a base supportable on a ground surface;

(b) said base having a wedge-shaped platform having a front end gradually sloping at an upward angle and a flat textured surface terminating at a heel-shaped end;

(c) said platform having two raised sidewalls extending generally vertically from the sides of the platform and terminating prior to the endpoint of the heel-shaped end and rim of said platform, with a curvature such that the top edge of the sidewalls can conform to the curvature of a prolate spheroid-shaped ball, and additionally creating an arc shaped space along the heel-shaped end;

(d) said sidewalls further having at least two tabs spaced on either side of said platform to further support said ball, said tabs being generally perpendicular to said platform and extending vertically from said sidewalls;

wherein said ball is supported by said kicking tee by said platform and further supported by said sidewalls and tabs, whereby said ball can be positioned on said tee in a forward lean configuration wherein the bottom of the ball is tilted at an angle extending away from the front end exposing the entire ball from tip to tip, while the top of prolate spheroid-shaped ball is tilted forward through said arc shaped space in said heel-shaped end, at an angle creating a segment of impact through said ball resulting in improved increase in the achievable distance, height, velocity and hangtime of said ball's trajectory.

2. The kicking tee of claim 1, wherein any placement of said ball on said kicking tee allows for unobstructed view of said ball and unobstructed impact and follow through with said ball when kicked.

3. The kicking tee of claim 1 wherein said kicking tee is made of either a plastic or rubber material having a durometer of hardness that is firm enough to support a football but soft enough such that the tee is pliable and flexible to withstand player impact without causing injury.

4. A kicking tee comprising:

(a) a base supportable on a ground surface;

(b) said base having a wedge-shaped platform having a front end gradually sloping at an upward angle and a flat textured surface terminating at a heel-shaped end;

(c) said platform having two raised sidewalls extending generally vertically form the sides of the platform and terminating prior to the endpoint of the heel-shaped end and rim of said platform with a curvature such that the top edge of the sidewalls can conform to the curvature of a prolate spheroid-shaped ball, and additionally creating an arc shaped space along the heel-shaped end;

(d) said sidewalls further having at least two tabs spaced on either side of said platform to further support said ball, said tabs being generally perpendicular to said platform and extending vertically form said sidewalls;

wherein said ball can be positioned on said tee in a forward lean configuration crating a segment of impact through side ball while allowing the entire surface area of the ball to be seen from tip to tip.

5. The kicking tee of claim 4 wherein any placement of said ball on said kicking tee allows for unobstructed view of side ball and unobstructed impact and follow through with said ball when kicked.

6. The kicking tee of claim 4 wherein said kicking tee is made of either a plastic or rubber material having a durometer of hardness that is firm enough to support a football but soft enough such that the tee is pliable and flexible to withstand player impact without causing injury.

* * * * *